US010283895B1

(12) United States Patent
Probert et al.

(10) Patent No.: US 10,283,895 B1
(45) Date of Patent: May 7, 2019

(54) ELECTRICAL TERMINAL ASSEMBLY WITH SPLIT SHROUD

(71) Applicant: Lear Corporation, Southfield, MI (US)

(72) Inventors: Deborah Probert, Farmington Hills, MI (US); Michael Glick, Farmington Hills, MI (US); David Menzies, Linden, MI (US); Michael James Porter, Traverse City, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 15/848,524

(22) Filed: Dec. 20, 2017

(51) Int. Cl.

| | |
|---|---|
| ***H01R 4/48*** | (2006.01) |
| ***H01R 13/50*** | (2006.01) |
| ***H01R 13/422*** | (2006.01) |
| ***H01R 13/115*** | (2006.01) |

(52) U.S. Cl.
CPC ..... *H01R 13/50* (2013.01); *H01R 13/115* (2013.01); *H01R 13/4223* (2013.01)

(58) Field of Classification Search
CPC ..... H01R 13/18; H01R 13/112; H01R 13/68; H01R 85/202
USPC ..... 439/839, 857, 620.26, 250
See application file for complete search history.

(56) References Cited

U.S. PATENT DOCUMENTS

| | | | | |
|---|---|---|---|---|
| 5,338,229 | A | 8/1994 | Egenolf | |
| 5,360,356 | A | 11/1994 | May et al. | |
| 5,362,262 | A | 11/1994 | Hotea | |
| 5,634,825 | A | 6/1997 | Maki | |
| 5,685,746 | A | 11/1997 | Maejima | |
| 5,921,821 | A | 7/1999 | Oka et al. | |
| 6,997,721 | B2 | 2/2006 | Shirota | |
| 7,766,706 | B2 | 8/2010 | Kawamura et al. | |
| 7,892,050 | B2 | 2/2011 | Pavlovic et al. | |
| 8,366,497 | B2 * | 2/2013 | Glick | H01R 9/245 439/839 |
| 9,142,902 | B2 | 9/2015 | Glick et al. | |
| 9,190,759 | B2 | 11/2015 | Balcerak et al. | |
| 9,548,553 | B2 | 1/2017 | Glick et al. | |
| 2014/0273659 | A1 | 9/2014 | Glick et al. | |

FOREIGN PATENT DOCUMENTS

| | | | |
|---|---|---|---|
| CN | 101286601 | A | 10/2008 |
| CN | 104037523 | A | 9/2014 |

* cited by examiner

*Primary Examiner* — Phuong Chi T Nguyen
(74) *Attorney, Agent, or Firm* — MacMillan, Sobanski & Todd, LLC

(57) ABSTRACT

An electrical terminal assembly includes a contact member with a contact base. A plurality of contact arms extend from the contact base in an arm direction. The contact arms are arranged on opposed sides of a terminal plane. The electrical terminal assembly includes a spring member supported on the contact member. The spring member includes a spring base. A plurality of spring arms extend from the spring base on opposed sides of the terminal plane in the arm direction. The spring arms engage the plurality of contact arms and bias the contact arms toward the terminal plane. The spring member also includes a shroud. The shroud extends in the arm direction around and beyond the contact arms. The shroud includes a terminal pass that the terminal plane is located in.

10 Claims, 4 Drawing Sheets

ELECTRICAL TERMINAL ASSEMBLY WITH SPLIT SHROUD

BACKGROUND OF THE INVENTION

This invention relates in general to an electrical terminal assembly. More specifically, this invention relates to an electrical terminal assembly that includes a spring member positioned on a contact member.

Electrical terminals commonly include a female terminal and a corresponding male terminal that may be mated to establish an electrical connection. Male electrical terminals are manufactured in various shapes, including pins and blades, and female electrical terminals are manufactured in complementary shapes that can engage the appropriate male terminal. Female terminals often include a contact portion having multiple contact arms that press onto sides of the male terminal. It is known to provide a female terminal with a spring member to increase the compression force between the male terminal and the female terminal. An example of one such spring member is shown in U.S. Pat. No. 7,892,050. The spring member is typically made of a material that, compared to the material of the contact portion, has inferior electrical conductivity but is less susceptible to relaxation. The spring member maintains the desired compression force without requiring that the size of the contact portion be increased and allows the female terminal to maintain a desired contact area with the male terminal, even when the temperature of the female terminal increases.

It is also known to provide a female terminal with front end protection. An example of such terminal front end protection is shown in U.S. Pat. No. 9,548,553. The terminal shown in the '553 patent includes a spring member having integral front end protection. The spring member engages contact arms to maintain a compression force between the female terminal and a corresponding male terminal, similar to the spring member described in the '050 patent. Additionally, the spring member includes a cage that extends around and past the contact arms. The cage protects the contact arms from damage during shipping, handling, installation, and use. Because the cage is part of the spring member, no additional pieces are added to the female terminal. It would be desirable to have a spring member that provides both a good compression force on the contact member and protection to the contact arms, and further may be used in combination with additional types male terminals.

SUMMARY OF THE INVENTION

The invention relates to an electrical terminal assembly. The electrical terminal assembly includes a contact member with a contact base. A plurality of contact arms extend from the contact base in an arm direction. The contact arms are arranged on opposed sides of a terminal plane. The electrical terminal assembly includes a spring member supported on the contact member. The spring member includes a spring base. A plurality of spring arms extend from the spring base on opposed sides of the terminal plane in the arm direction. The spring arms engage the plurality of contact arms and bias the contact arms toward the terminal plane. The spring member also includes a shroud. The shroud extends in the arm direction around and beyond the contact arms. The shroud includes a terminal pass that the terminal plane is located in.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
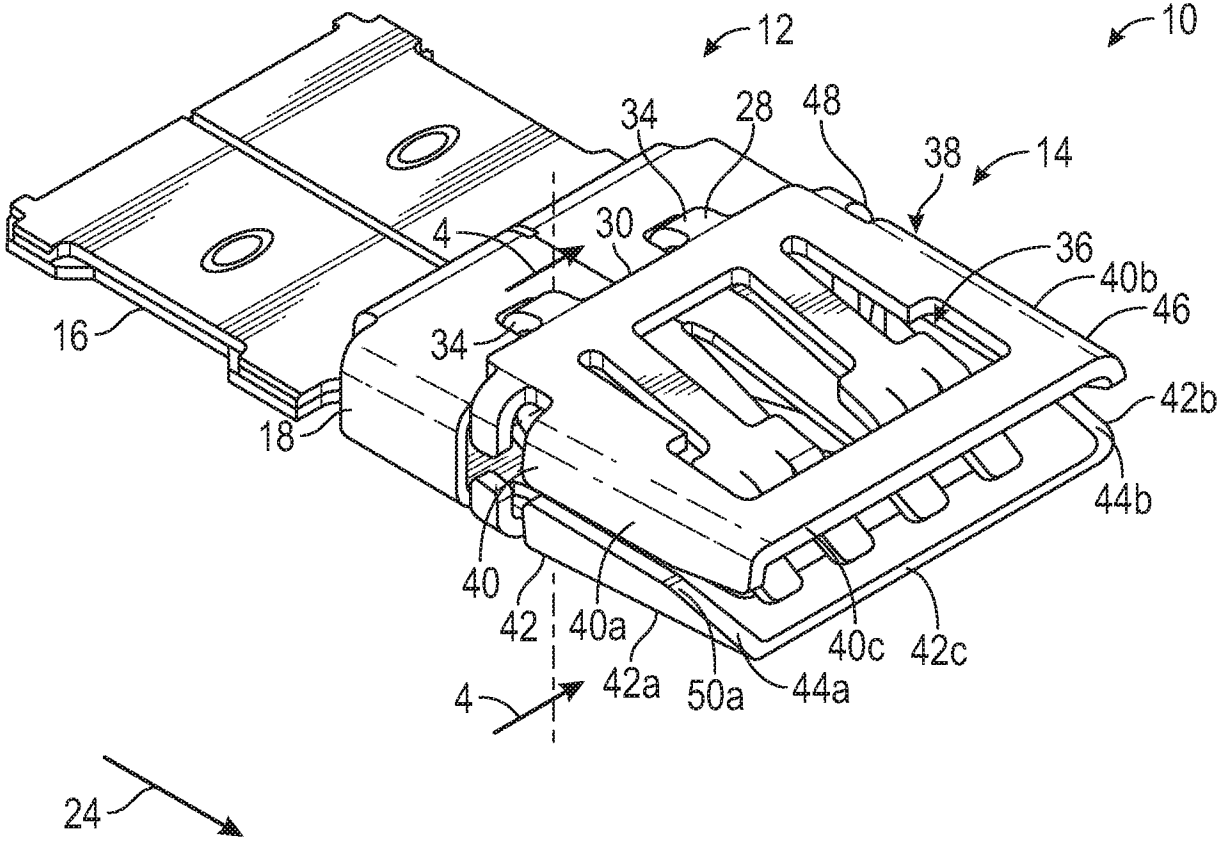
FIG. 1 is a perspective view of an electrical terminal assembly in accordance with this invention.
Figure 2:
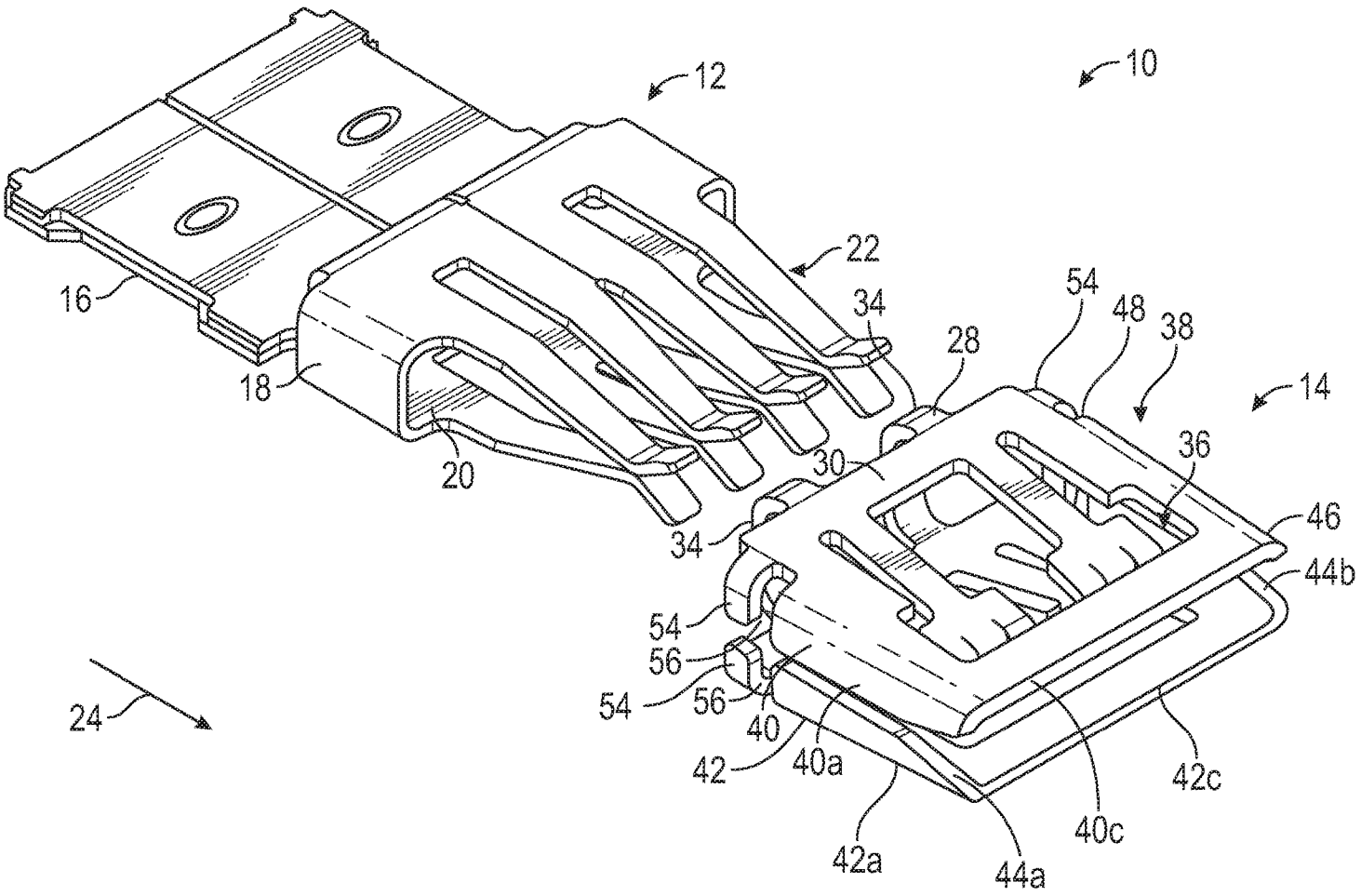
FIG. 2 is an exploded perspective view of the electrical terminal assembly illustrated in FIG. 1, showing a contact member separate from a spring member.
Figure 4:
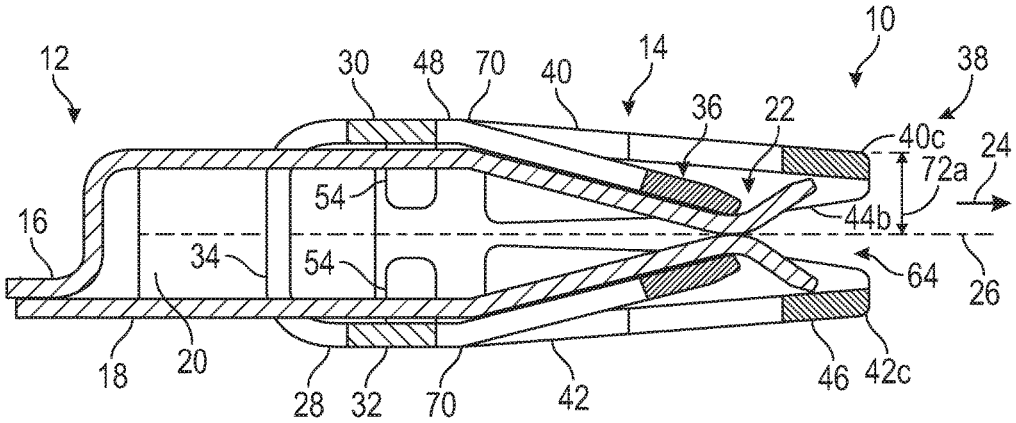
FIG. 4 is a cross-sectional view taken along the line 4-4 of FIG. 1.

Referring now to the drawings, there is illustrated in FIG. 1 a perspective view of an electrical terminal assembly, indicated generally at 10, in accordance with this invention. The electrical terminal assembly 10 includes a contact member, indicated generally at 12, and a spring member, indicated generally at 14. FIG. 2 is an exploded perspective view of the electrical terminal assembly 10, showing the contact member 12 separate from the spring member 14. FIG. 4 is a cross-sectional view of the electrical terminal assembly 10 taken along the line 4-4 of FIG. 1. Details of the electrical terminal assembly 10 will be described in reference to these figures.

The illustrated contact member 12 is made from a single sheet of material, stamped and folded into the illustrated configuration. However, the contact member 12 may be made by any desired process. The illustrated contact member 12 is made of copper, but may be made of any desired material. Preferably, the contact member 12 is made of a material with good electrical conductivity, such as aluminum.

The contact member 12 includes a connection portion 16 that is configured to be connected to an electrical conductor, such as a wire (not shown). The connection portion 16 may be configured for any desired type of connection. The contact member 12 includes a contact base 18 that is connected to the connection portion 16. The illustrated contact base 18 is a substantially rectangular cross-sectional shaped box that defines an interior space 20. However, the contact base 18 may have any desired shape.

The contact member 12 includes a plurality of contact arms, indicated generally at 22, that extend from the contact base 18 in an arm direction 24. In the illustrated embodiment, the connection portion 16 and the contact arms 22 are located on opposite sides of the contact base 18, but the components may have any desired relative orientations. The contact arms 22 are arranged on opposed sides of a terminal plane 26. In the illustrated embodiment, the contact member 12 includes a total of eight contact arms 22 arranged in four opposed pairs, but the contact member 12 may have any desired number and arrangement of contact arms 22.

The illustrated spring member 14 is made from a single sheet of material that is stamped and folded into the illustrated configuration. However, the spring member 14 may be made by any desired process. The illustrated spring member 14 is made of stainless steel, but may be made of any desired material. Preferably, the spring member 14 is made of a material with good spring characteristics even at relatively high temperatures.

The spring member 14 includes a spring base 28. The illustrated spring base 28 includes a first bridge 30 and a second bridge 32 that are each connected to two U-shaped struts 34. However, the spring base 28 may have any desired shape. The illustrated first bridge 30 and second bridge 32 are located on opposed sides of the terminal plane 26 and are symmetrical across the terminal plane 26. The illustrated struts 34 cross the terminal plane 26 and, in the illustrated embodiment, are the only part of the spring member 14 that the terminal plane 26 passes through. The spring member 14 also includes a plurality of spring arms, indicated generally at 36, that extend from the spring base 28 in the arm direction 24. In the illustrated embodiment, the spring member 14 includes two spring arms 36 that extend from the first bridge 30 and two spring arms 36 that extend from the second bridge 32. The spring arms 36 are arranged on opposed sides of the terminal plane 26 in opposed pairs, with two on either side of the terminal plane 26. However, the spring member 14 may have any desired number and arrangement of spring arms 36.

The spring member 14 includes a shroud, indicated generally at 38. The illustrated shroud 38 includes a first shroud portion 40 and a second shroud portion 42 that are located on opposed sides of the terminal plane 26. The illustrated first shroud portion 40 is attached to the first bridge 30 of the spring base 28, while the second shroud portion 42 is attached to the second bridge 32 of the spring base 28. The illustrated first shroud portion 40 and second shroud portion 42 are mirror images of each other across the terminal plane 26, but may have any desired shapes. Additionally, the shroud 38 may be made from any desired number and arrangement of portions.

The first shroud portion 40 includes a first portion first side shield 40*a* that is connected to the spring base 28 and extends in the arm direction 24 farther than the spring arms 36. The first shroud portion 40 also includes a first portion second side shield 40*b* that is connected to the spring base 28 and extends in the arm direction 24 farther than the spring arms 36. The first portion first side shield 40*a* and the first portion second side shield 40*b* are located on opposed sides of the spring arms 36 and are each connected to a first end shield 40*c* that is located in the arm direction 24 past the spring arms 36.

Similarly, the second shroud portion 42 includes a second portion first side shield 42*a* that is connected to the spring base 28 and extends in the arm direction 24 farther than the spring arms 36. The second shroud portion 42 also includes a second portion second side shield 42*b* that is connected to the spring base 28 and extends in the arm direction 24 farther than the spring arms 36. The second portion first side shield 42*a* and second portion second side shield 42*b* are located on opposed sides of the spring arms 36 and are each connected to a second end shield 42*c* that is located in the arm direction 24 past the spring arms 36.

When the electrical terminal assembly 10 is assembled, as shown in FIG. 1, the shroud 38 extends around and beyond the contact arms 22 of the contact member 12 in order to provide side and end protection for the contact arms 22 during handling, installation, and use. The side shields 40*a*, 40*b*, 42*a*, and 42*b* prevent the contact arms 22 from being inadvertently contacted from the sides, and the end shields 40*c* and 42*c* prevent the contact arms 22 from being inadvertently contacted from the front of the electrical terminal assembly 10.

The first portion first side shield 40*a* is located across the terminal plane 26 from the second portion first side shield 42*a*. The first portion first side shield 40*a* and the second portion first side shield 42*a* are separated by a first side gap 44*a*. The first side gap 44*a* extends from a mate end 46 of the shroud 38, which is the end of the shroud 38 located away from the spring base 28, to a base end 48 of the shroud 38, which is the end of the shroud 38 located nearest the spring base 28. The terminal plane 26 passes through the first side gap 44*a*.

The first side gap 44*a* has a height that changes between the mate end 46 and the base end 48 of the shroud 38. The height of the first side gap 44*a* varies with the distance between first portion first side shield 40*a* and the second portion first side shield 42*a*. In the illustrated embodiment, the height of the first side gap 44*a* is the greatest at the mate end 46 and gradually reduces in height from the mate end 46 to a first gap transition 50*a*. Thereafter, the first side gap 44*a* continues to reduce in height from the first gap transition 50*a* to the base end 48 of the shroud 38, but it does so at a lower rate compared to the portion between the mate end 46 and the first gap transition 50*a*.

Similarly, the first portion second side shield 40*b* is located across the terminal plane 26 from the second portion second side shield 42*b*. The first portion second side shield 40*b* and the second portion second side shield 42*b* are separated by a second side gap 44*b*. The second side gap 44*b* extends from the mate end 46 of the shroud 38 to the base end 48 of the shroud 38, and the terminal plane 26 passes through the second side gap 44*b*.

Similar to the first side gap 44*a*, the second side gap 44*b* has a height that changes between the mate end 46 and the base end 48 of the shroud 38. The height of the second side gap 44*b* varies with the distance between first portion second side shield 40*b* and the second portion second side shield 42*b*. The illustrated second side gap 44*b* is the greatest at the mate end 46 and reduces in height from the mate end 46 to a second gap transition (not shown). Thereafter, the second side gap 44*b* continues to reduce in height from the second gap transition to the base end 48 of the shroud 38, but at a lower rate compared to the portion between the mate end 46 and the second gap transition.

The illustrated spring member 14 also includes a plurality of spring tabs 54 that serve to properly position the spring member 14 relative to the contact member 12. The spring tabs 54 extend from the spring base 28 toward the terminal plane 26. In the illustrated embodiment, the spring member 14 includes four spring tabs 54, two on the first bridge 30 and two on the second bridge 32. When the electrical terminal assembly 10 is assembled, the spring tabs 54 are located between the shroud 38 and the contact base 18. A spring cut-out 56 is located between each spring tab 54 and the shroud 38. Each spring cut-out 56 is an open space located between one of the spring tabs 54 and the shroud 38.

Figure 3:
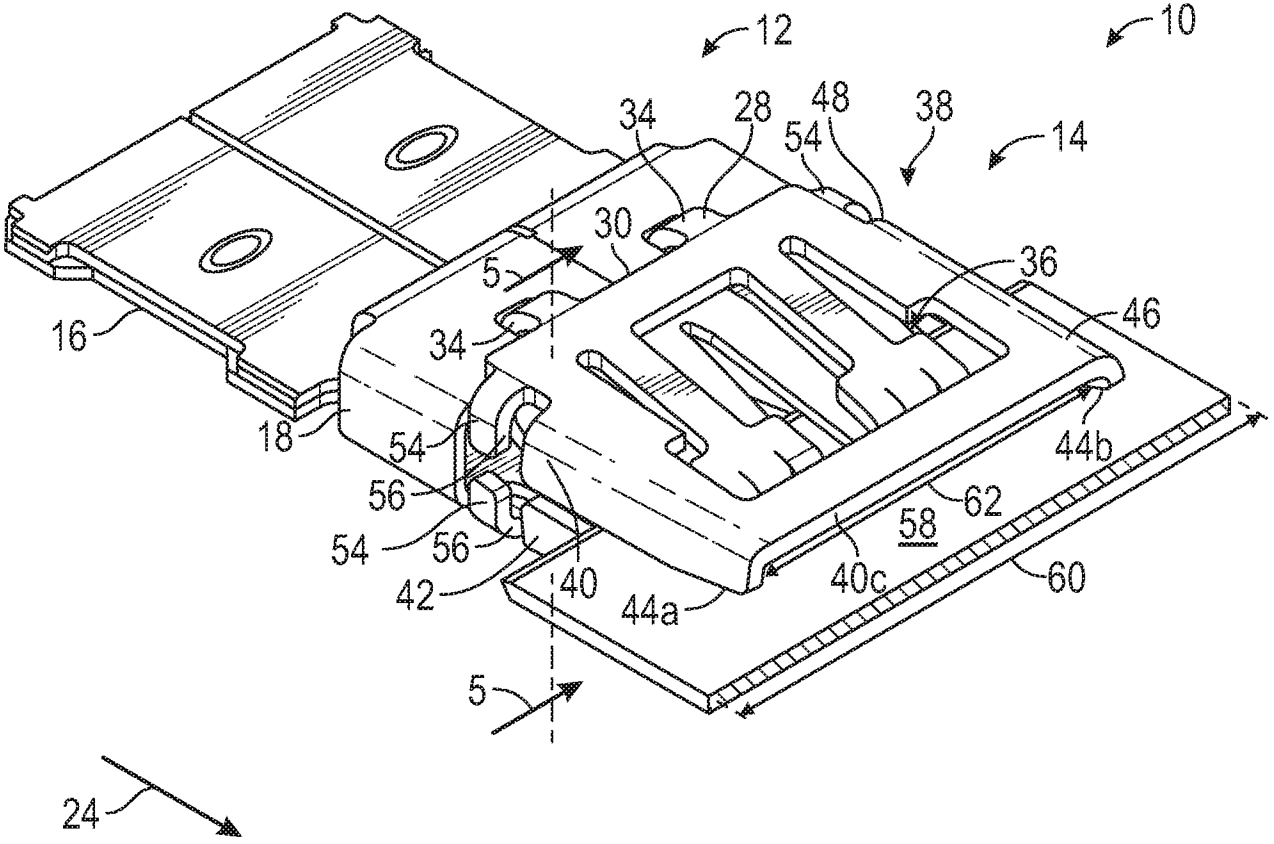
FIG. 3 is a perspective view similar to FIG. 1, but additionally showing the electrical terminal assembly mated with a corresponding male electrical terminal.
Figure 5:
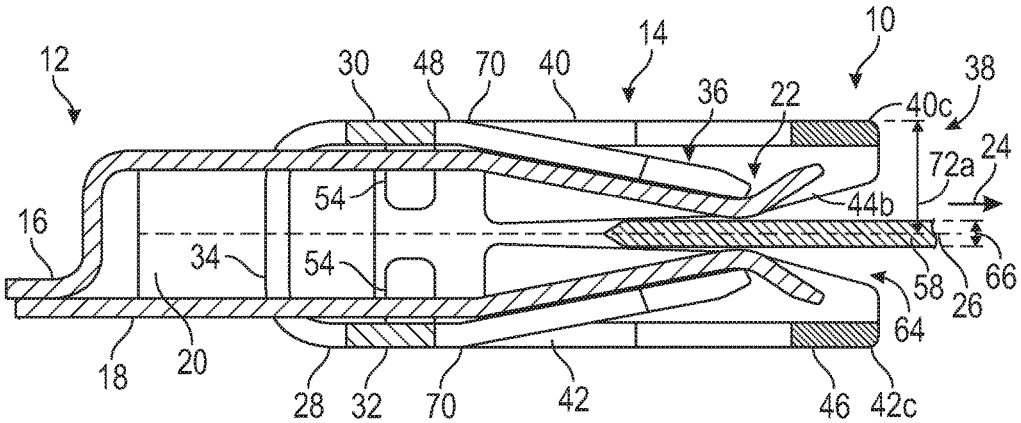
FIG. 5 is a cross-sectional view taken along the line 5-5 of FIG. 3.

Referring now to FIG. 3, a perspective view similar to FIG. 1 is illustrated, with a corresponding terminal 58 shown mated with the electrical terminal assembly 10. FIG. 5 is a cross-sectional view taken along the line 5-5 of FIG. 3. The corresponding terminal 58 is a male, blade-type terminal, but may be any desired type of electrical terminal. The illustrated corresponding terminal 58 is an oversized terminal and has a terminal width 60 that is greater than an internal width 62 of the electrical terminal assembly 10. The internal width 62 is the distance between the side shield portions 40*a*, 42*a*, 40*b*, and 42*b* of the shroud 38 along the terminal plane 26. A conventional electrical terminal assembly typically cannot be mated with a male terminal that is wider than the electrical terminal assembly's internal width because the male terminal would engage side shields of the shroud, preventing the terminals from engaging.

As best seen in FIG. 4, the first side gap 44*a* and the second side gap 44*b* together provide the shroud 38 with a terminal pass, indicated generally at 64. The terminal pass 64 extends across the terminal plane 26 and allows the corresponding terminal 58 to mate with the electrical terminal assembly 10 by allowing the oversized corresponding terminal 58 to engage the contact arms 22 without engaging the spring member 14. The terminal pass 64 includes portions of the first side gap 44*a* and the second side gap 44*b* at the mate end 46 of the shroud 38 that are taller than a terminal thickness 66 of the corresponding terminal 58. This allows the corresponding terminal 58 to be moved past the mate end 46 of the shroud 38 and engage the contact arms 22 without engaging the shroud 38.

When the corresponding terminal 58 engages the contact arms 22 of the electrical terminal assembly 10, the contact arms 22 are pushed apart in opposite directions away from the terminal plane 26. The contact arms 22 will bend relative to the contact base 18, and the contact arms 22 on either side of the terminal plane 26 will be moved a distance substantially equal to one-half of the terminal thickness 66 of the corresponding terminal 58. Additionally, the spring arms 36 will also be pushed apart in opposite directions away from the terminal plane 26.

As previously described, the illustrated spring member 14 is symmetrical across the terminal plane 26. As a result the spring member 14 will normally experience equal deflection on each side of the terminal plane 26. Because the bridge 30 and the bridge 32 are not fixed on the contact base 18, when the spring arms 36 are pushed away from the terminal plane 26, the spring arms 36 and the bridges 30 and 32 will bend relative to the struts 34. As previously described, the first shroud portion 40 is attached to the first bridge 30, and the second shroud portion 42 is attached to the second bridge 32. Thus, when the spring arms 36 are pushed away from the terminal plane 26, the first shroud portion 40 and the second shroud portion 42 will move with the first bridge 30, and the second bridge 32 and will rotate away from the terminal plane 26. As a result, the heights of the first side gap 44*a* and the second side gap 44*b* will increase as the springs arms 36 are pushed apart. This can be seen by comparing the relative heights of the second side gap 44*b* in FIGS. 4 and 5.

Referring to FIG. 4, it should be appreciated that the height of the first side gap 44*a* between the first gap transition 50*a* and the base end 48 of the shroud 38 may, if desired, be smaller than the terminal thickness 66 of the corresponding terminal 58 when the electrical terminal assembly 10 is assembled. However, as shown in FIG. 5, when the corresponding terminal 58 engages the contact arms 22, it pushes the shroud portions 40 and 42 apart, increasing the height of the first side gap 44*a* to accommodate the corresponding terminal 58. This prevents the spring member 14 from engaging the corresponding terminal 58, which may be advantageous in order to avoid the spring member 14 from damaging the corresponding terminal 58.

Referring again the FIG. 4, the spring member 14 has a tapered profile between the mate end 46 of the shroud 38 and the spring base 28 relative to the terminal plane 26. From the mate end 46, the spring member 14 tapers farther from the terminal plane 26 to a spring bend 70. In the illustrated embodiment, the spring bend 70 is located on the shroud 38 between the spring base 28 and the mate end 46, near the spring base 28. However, the spring bend 70 may be located in any desired position. From the spring bend 70, the spring member 14 tapers closer to the terminal plane 26 back to the struts 34. In the illustrated embodiment, both the first shroud portion 40 and the second shroud portion 42 include similar symmetrical spring bends 70. As a result, the mate end 46 of the shroud 38 is positioned at an unmated distance 72*a* from the terminal plane 26 when the electrical terminal assembly 10 is initially assembled.

As previously described, when the electrical terminal assembly 10 is mated with the corresponding terminal 58, the first bridge 30 and the second bridge 32 are pushed away from the terminal plane 26 by the spring arms 36. This also moves the first shroud portion 40 and the second shroud portion 42, causing such shroud portions 40 and 42 to rotate away from the terminal plane 26. As a result, the mate end 46 of the shroud 38 is positioned at a mated distance 72*b* from the terminal plane 26 when the electrical terminal assembly 10 is mated with the corresponding terminal 58. Because the first shroud portion 40 and the second shroud portion 42 rotate about lines located near the spring base 28, the mate end 46 is the part of the shroud 38 that experiences the largest amount of linear movement when the electrical terminal assembly 10 is mated with the corresponding terminal 58. The spring bend 70 positions the mate end 46 of the shroud 38 closer to the terminal plane 26 than it would be if the spring member 14 did not include the spring bend 70.

It should be appreciated that a terminal housing (not shown) that houses the electrical terminal assembly 10 will be large enough to accommodate the electrical terminal assembly 10 when it is mated with the corresponding terminal 58 and is at its largest size. The spring bend 70 does not reduce the height of the assembled electrical terminal assembly 10 that, in the illustrated embodiment, is at the spring bend 70. However, the spring bend 70 reduces the height of the electrical terminal assembly 10 at the mate ends 46 when the electrical terminal assembly 10 is mated with the corresponding connector 58. Thus, the required size of the terminal housing can be reduced without having to reduce the size of the entire electrical terminal assembly 10.

In the illustrated embodiment, the spring bend 70 is a bend in the material of the spring member 14. However, the spring bend 70 may be embodied as some other feature or characteristic that provides the spring member 14 with a reduced height at the mate end 46. For example, part of the shroud 38 may be cut away at the mate end 46, or the material of the shroud 38 may be thinner at the mate end 46.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An electrical terminal assembly comprising:

a contact member including a contact base and a plurality of contact arms that extend from the contact base in an arm direction and are arranged on opposed sides of a terminal plane; and a spring member supported on the contact member including a spring base, a plurality of spring arms that extend from the spring base on opposed sides of the terminal plane in the arm direction, engage the plurality of contact arms, and bias the contact arms toward the terminal plane, and a shroud that extends from the spring base in the arm direction both around and beyond the contact arms, the shroud including a terminal pass that the terminal plane is located in.

2. The electrical terminal assembly of claim 1, including a first side gap between a first portion of a first side shield and a second portion of a first side shield, the first side gap having a greatest height at a mate end of the shroud located away from the spring base and a lower height at a base end of the shroud located nearest the spring base.

3. The electrical terminal assembly of claim 1, the shroud including a first side shield and a second side shield located on opposed sides of the contact arms, the first side shield including a first portion and a second portion located on opposed sides of the terminal plane and the second side shield including two portions located on opposed sides of the terminal plane.

4. The electrical terminal assembly of claim 3, the spring member being symmetrical across the terminal plane.

5. The electrical terminal assembly of claim 1, the spring member including a spring bend between the spring base and a mate end of the shroud located away from the spring base so that the mate end of the shroud tapers toward the terminal plane.

6. The electrical terminal assembly of claim 5, the shroud including a first shroud portion attached to the spring base on a first side of the terminal plane and a second shroud portion attached to the spring base on an opposed, second side of the terminal plane.

7. The electrical terminal assembly of claim 6, the shroud base including a first bridge located on the first side of the terminal plane and a second bridge located on the second side of the terminal plane, the shroud base further including a strut that is connected to the first bridge and the second bridge.

8. The electrical terminal assembly of claim 7, the spring member being symmetrical across the terminal plane.

9. The electrical terminal assembly of claim 8, the spring member including spring tabs that are located between the shroud and the contact base.

10. The electrical terminal assembly of claim 9, the spring member defining spring cut-outs between the spring tabs and the shroud.

* * * * *